US009305676B2

(12) United States Patent
Miyake

(10) Patent No.: US 9,305,676 B2
(45) Date of Patent: Apr. 5, 2016

(54) COMPOSITE MATERIAL, ELECTRIC CONTACT ELECTRODE, ELECTRIC CONTACT FILM, CONDUCTIVE FILLER, ELECTRIC CONTACT STRUCTURE USING COMPOSITE MATERIAL, AND MANUFACTURING METHOD OF COMPOSITE MATERIAL

(71) Applicant: DENSO CORPORATION, Kariya, Aichi-pref. (JP)

(72) Inventor: Toshihiro Miyake, Kariya (JP)

(73) Assignee: DENSO CORPORATION, Kariya (JP)

( * ) Notice: Subject to any disclaimer, the term of this patent is extended or adjusted under 35 U.S.C. 154(b) by 529 days.

(21) Appl. No.: 13/630,056

(22) Filed: Sep. 28, 2012

(65) Prior Publication Data

US 2013/0081855 A1 Apr. 4, 2013

(30) Foreign Application Priority Data

Oct. 4, 2011 (JP) ..... 2011-220318

(51) Int. Cl.

| | |
|---|---|
| ***H01B 1/02*** | (2006.01) |
| ***H01R 13/03*** | (2006.01) |
| *C25D 3/32* | (2006.01) |
| *C25D 3/38* | (2006.01) |
| *C25D 3/58* | (2006.01) |
| *C25D 3/60* | (2006.01) |
| *C25D 15/00* | (2006.01) |

(52) U.S. Cl.

CPC ..... *H01B 1/026* (2013.01); *H01B 1/02* (2013.01); *H01R 13/03* (2013.01); *C25D 3/32* (2013.01); *C25D 3/38* (2013.01); *C25D 3/58* (2013.01); *C25D 3/60* (2013.01); *C25D 15/00* (2013.01)

(58) Field of Classification Search

CPC ..... H01B 1/02; H01B 1/026; H01B 13/00; B22F 2999/00; B22F 1/0059; C23C 18/38; C23C 18/40; H01R 13/02; H01R 13/03; H01H 1/02; H01H 1/025

See application file for complete search history.

(56) References Cited

U.S. PATENT DOCUMENTS

| | | | | |
|---|---|---|---|---|
| 5,004,498 | A * | 4/1991 | Shimamura et al. | 75/233 |
| 6,398,855 | B1 * | 6/2002 | Palmans et al. | 106/1.23 |
| 2003/0085133 | A1 | 5/2003 | Totsuka et al. | |
| 2005/0166790 | A1 | 8/2005 | Urata et al. | |
| 2010/0326838 | A1 | 12/2010 | Hartmann et al. | |
| 2011/0012262 | A1 * | 1/2011 | Morita et al. | 257/741 |

(Continued)

FOREIGN PATENT DOCUMENTS

| | | |
|---|---|---|
| JP | A-54-69531 | 6/1979 |
| JP | A-6-330392 | 11/1994 |

(Continued)

OTHER PUBLICATIONS

Office Action mailed Nov. 26, 2013 in corresponding JP Application No. 2011-220318 (with English translation).

(Continued)

*Primary Examiner* — Mark Kopec

(74) *Attorney, Agent, or Firm* — Posz Law Group, PLC

(57) ABSTRACT

A composite material includes a metal matrix of a metal and a reducing agent. The reducing agent is dispersed in the metal matrix and is capable of reducing an oxide of the metal at room temperature. Even when the oxide of the metal is generated on a surface of the composite material, the reducing agent reduces the oxide of the metal to the metal

12 Claims, 6 Drawing Sheets

(56) References Cited

U.S. PATENT DOCUMENTS

| | | | | |
|---|---|---|---|---|
| 2014/0102759 | A1* | 4/2014 | Schmidt | H01H 1/02 174/126.1 |
| 2014/0124376 | A1 | 5/2014 | Hartmann et al. | |

FOREIGN PATENT DOCUMENTS

| | | | |
|---|---|---|---|
| JP | 2000-273684 | A | 10/2000 |
| JP | A-2001-220691 | | 8/2001 |
| JP | 2002-146585 | A | 5/2002 |
| JP | 2003-342621 | A | 12/2003 |
| JP | 2005-120425 | A | 5/2005 |
| JP | A-2008-248294 | | 10/2008 |
| JP | B2-4176081 | | 11/2008 |
| JP | A-2009-191285 | | 8/2009 |
| JP | A-2011-29395 | | 2/2011 |
| WO | WO2012159917 | A1 * | 11/2012 |

OTHER PUBLICATIONS

DE Office Action issued on Oct. 12, 2015 in the corresponding DE application No. 102012218134.2 (English translation attached).

* cited by examiner

FIG. 6

| No. | | PLATING BATH | | | | | | PLATING CURRENT DENSITY ($A/dm^2$) | C IN PLATING FILM (mass%) | CONTACT RESISTANCE (mΩ) | |
|---|---|---|---|---|---|---|---|---|---|---|---|
| | | $CuSO_4$ (M) | $H_2SO_4$ (g/L) | REDUCING AGENT | | COMPLEXING AGENT | | | | INITIAL | AFTER SLIDING |
| | | | | TYPE | CONT. (M) | TYPE | CONT. (M) | | | | |
| 1 | COMPARATIVE EXAMPLE | 0.8 | 53 | — | — | — | — | 6 | 0.4 | 1.03 | 1017.00 |
| 2 | EXAMPLE 1 | 0.8 | 53 | L-ASCORBIC ACID | 0.8 | 2,2'-BIPYRIDYL | 0.02 | 6 | 0.7 | 1.10 | 658.50 |
| 3 | EXAMPLE 2 | 0.8 | 53 | L-ASCORBIC ACID | 0.8 | 2,2'-BIPYRIDYL | 0.02 | 18 | 0.9 | 1.06 | 13.18 |
| 4 | EXAMPLE 3 | 0.8 | 53 | L-ASCORBIC ACID | 0.8 | 1,10-PHENANTHROLINE | 0.02 | 6 | 1.1 | 1.29 | 2.25 |

COMPOSITE MATERIAL, ELECTRIC CONTACT ELECTRODE, ELECTRIC CONTACT FILM, CONDUCTIVE FILLER, ELECTRIC CONTACT STRUCTURE USING COMPOSITE MATERIAL, AND MANUFACTURING METHOD OF COMPOSITE MATERIAL

CROSS REFERENCE TO RELATED APPLICATIONS

The present application is based on and claims priority to Japanese Patent Application No. 2011-220318 filed on Oct. 4, 2011, the contents of which are incorporated in their entirety herein by reference.

TECHNICAL FIELD

The present disclosure relates to a composite material and a manufacturing method of a composite material. The present disclosure also relates to an electric contact electrode, an electric contact film, a conductive filler, and an electric contact structure using a composite material.

BACKGROUND

Conventionally, an electric contact, such as a connector, is made of copper or copper alloy electrode. The electrode is plated with nickel, and then an outermost surface of the electrode is plated with tin.

When a temperature of usage environment changes, an electronic device and the like having an electric connection at an electric contact repeats expansion and contraction based on a thermal expansion coefficient of material used for the device. Accordingly, a repeated micro sliding of the electric contact occurs.

Due to the repeated micro sliding, the electric contact may be worn away, and oxidation of tin covering the electric contact may proceed at a contact portion. Accordingly, a contact resistance may increase, and the electronic device and the like may malfunction.

FIG. 1 is a diagram shoving an electric contact film according to a related art. When electric contact films 11*a*, 11*b* are worn away due to a repeated micro sliding, an oxide 12 is formed at an interface. Accordingly, resistances of the electric contact films 11*a*, 11*b* increase, and thereby the electronic device and the like malfunctions.

In order to solve the above-described issue, an outermost surface of an electrode may be plated with gold after plated with nickel. When the outermost surface of the electrode is covered with gold, oxidation does not progress even if a sliding occurs. Thus, the contact resistance does not increase due to oxidation.

However, under circumstances in which a micro sliding occurs for a long time, a gold plating film may be worn away due to the micro sliding. If the gold plating film on the surface of the electric contact is fully worn away, a nickel plating film under gold is exposed, and oxidation of nickel progresses due to the micro sliding. As a result, the contact resistance increases. Therefore, in order to secure a sufficient sliding life, it needs to increase a thickness of the gold plating film, and a cost increases.

JP-A-54-69531, JP-A-6-330392, JP-A-2008-248294 disclose films in which lubricant-filled microcapsules are dispersed in metal matrix using a composite plating method as examples of electric contacts for increasing a sliding life without a thick gold plating film.

In the films, the minimum dispersion size of the microcapsules is about 3 μm, and a lubricant starts to function after wear progresses to an extent. Thus, an effect of restricting wear is not sufficient. In addition, because the films do not have a function of restricting oxidation of a surface of an electric contact, an oxide film may be formed at the electric contact, and the contact resistance may increase.

Japanese Patent No. 4,176,081 discloses an electrode in which a depressed portion is provided on a plating surface, and then the plating surface is impregnated with fluorine compound. Also in this electrode, there is the above-described issue.

SUMMARY

It is an object of the present disclosure to provide a composite material that can provide a long sliding life. Other objects of the present disclosure are to provide an electric contact electrode, an electric contact film, a conductive filler, and an electric contact structure using the composite material, and to provide a manufacturing method of a composite material, an electric contact electrode, an electric contact film, and a conductive filler.

According to a first aspect of the present disclosure, a composite material includes a metal matrix of a metal and a reducing agent dispersed in the metal matrix and being capable of reducing an oxide of the metal at room temperature.

Even when the oxide of the metal is generated on a surface of the composite material, the reducing agent reduces the oxide of the metal to the metal. Thus, the composite material can provide a long sliding life.

According to a second aspect of the present disclosure, an electric contact electrode is made of the composite material according to the first aspect.

According to a third aspect of the present disclosure, an electric contact film is made of the composite material according to the first aspect.

According to a fourth aspect of the present disclosure, a conductive filler is made of the composite material according to the first aspect.

According to a fifth aspect of the present disclosure, an electric contact structure includes a first electrode and a second electrode being in contact with the first electrode, and one of the first electrode and the second electrode is the electric contact electrode according to the second aspect.

According to a sixth aspect of the present disclosure, an electric contact structure includes a first electrode, a second electrode being in contact with the first electrode, and the electric contact film according to the third aspect covering a surface of one of the first electrode and the second electrode.

According to a seventh aspect of the present disclosure, an electric contact structure includes a first electrode, an intermediate film made of the conductive filler according to the fourth aspect or an adhesive agent in which the conductive filler according to the fourth aspect is dispersed, and a second electrode being in contact with the first electrode through the intermediate film.

According to an eighth aspect of the present disclosure, in a manufacturing method of the composite material according to the first aspect, a plating bath including a metal salt of the metal is prepared, the reducing agent is dissolved in the plating bath or mixed in the plating bath so as to be a colloidal state, and a plated member is electroplated in the plating bath so as to obtain the composite material by forming eutectoid of the metal and the reducing agent on the plated member.

According to a ninth aspect of the present disclosure, in a manufacturing method of an electric contact electrode, the composite material is manufactured by the manufacturing method according to the eighth aspect, and the eutectoid formed on the plate member is processed.

According to a tenth aspect of the present disclosure, in a manufacturing method of an electric contact film, the composite material is manufactured by the manufacturing method according to the eighth aspect, the plated member is an electric contact electrode, and the eutectoid formed on the plated member is the electric contact film.

According to an eleventh aspect of the present disclosure, in a manufacturing method of a conductive film, the composite material is manufactured by the manufacturing method according to the eighth aspect, and the eutectoid formed on the plated member is detached to form the conductive filler.

BRIEF DESCRIPTION OF THE DRAWINGS

Additional objects and advantages of the present disclosure will be more readily apparent from the following detailed description when taken together with the accompanying drawings. In the drawings:

FIG. 6 is a diagram showing manufacturing conditions and results of the sliding test.

DETAILED DESCRIPTION

The inventor studied on a method that can increase a sliding life of an electric contact made of low-cost metal.

As a result of the study, the inventor found that when an electric contact is b formed by using a composite material in which a reducing agent that is capable of reducing an oxide of a metal at room temperature is dispersed in a metal matrix of the metal for an electric contact electrode, an electric contact film, or a conductive filler, even if the metal at a contact point is oxidized due to a repeated micro sliding, the reducing agent in the electrode, the film, or the conductive filler reduces the oxide of the metal to the metal.

The inventor also found that the composite material can be formed by adding the reducing agent and a complexing material as needed to a plating bath that includes a metal salt of the metal as primary component and performing electroplating so that eutectoid of the metal and the reducing agent is formed on a plated member.

Embodiments of the present disclosure will be described below.

Figure 1:
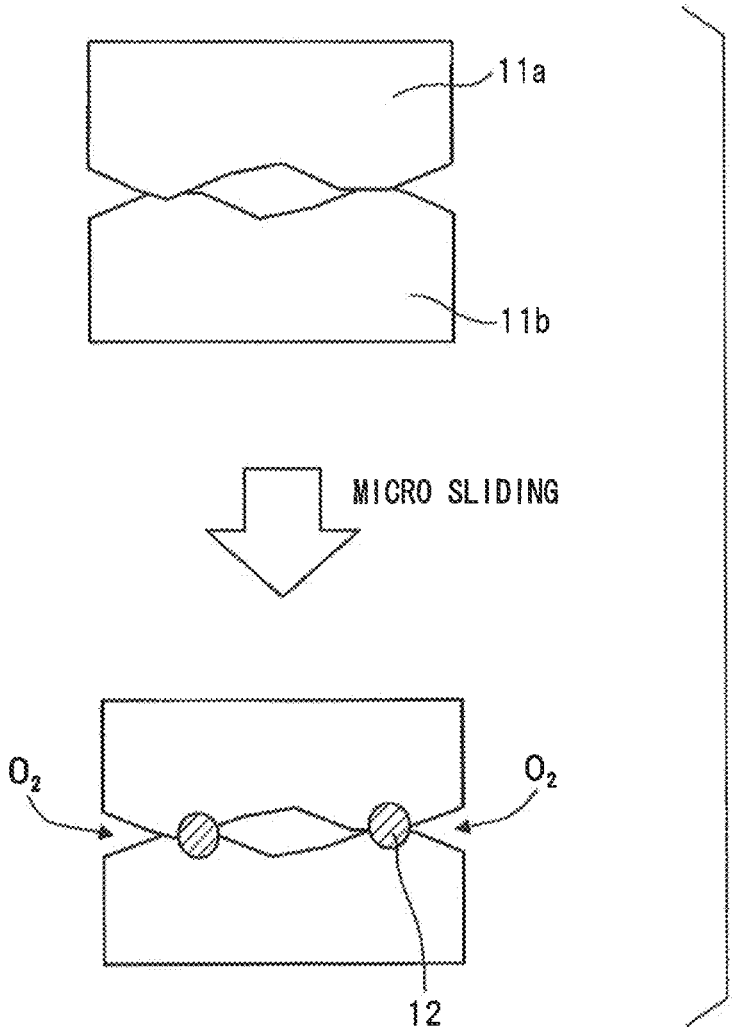
FIG. 1 RELATED ART
FIG. 1 is a diagram showing electric contact films according to a related art in which an oxide of tin is generated.
Figure 2:
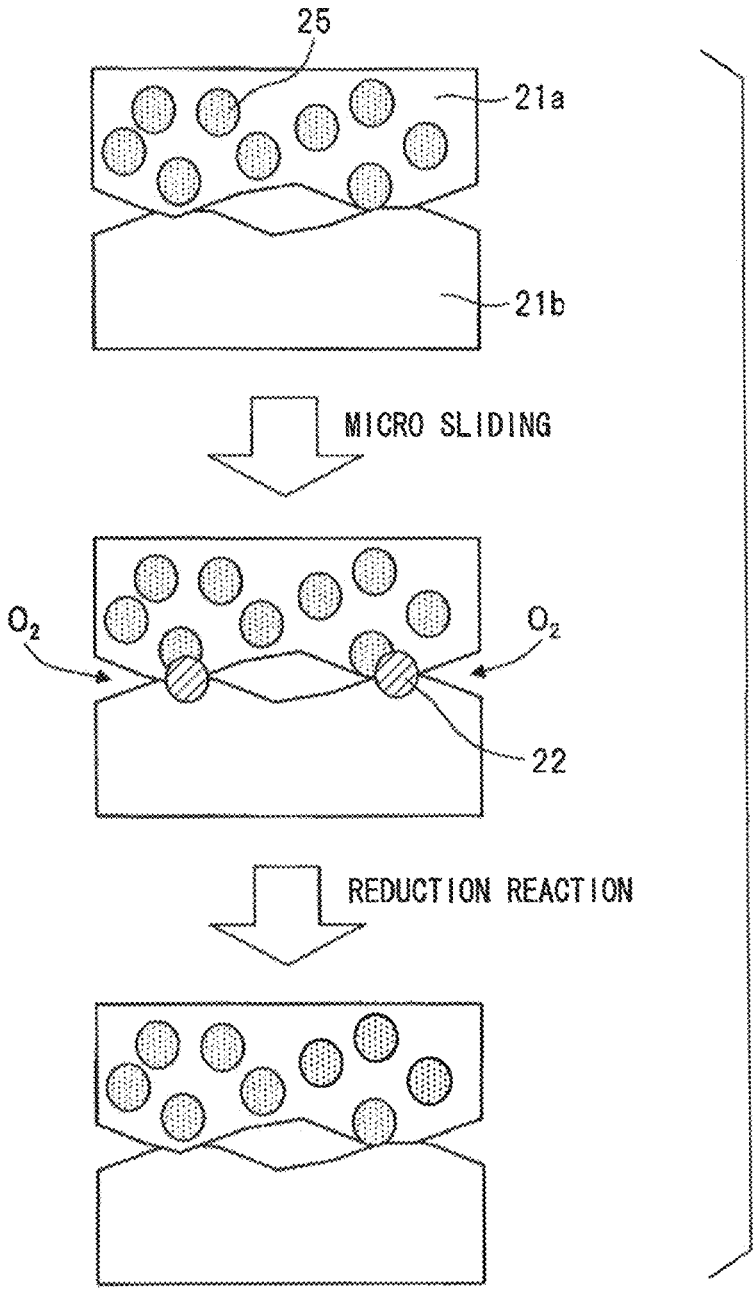
FIG. 2 is a diagram showing a reduction of an oxide generated at an electric contact according to an embodiment of the present disclosure

Electric contact films 21*a*, 21*b* made of a composite material according to an embodiment of the present disclosure will be described with reference to FIG. 2. In the composite material, a reducing agent 25 is dispersed.

When a temperature of usage environment of an electric contact or when the electric contact vibrates, a repeated micro sliding of an electric contact portion occurs. Accordingly, the electric contact wears, a metal of the electric contact is oxidized at a contact portion, and an oxide 22 of the metal is generated at an interface of the electric contact.

Because the reducing agent 25 is dispersed in the composite material, when the electric contact wears, the reducing agent 25 is exposed.

The reducing agent 25 is capable of reducing the oxide 22 of a metal matrix of the metal at room temperature. Thus, the reducing agent 25, which is exposed, reduces the oxide 22 of the metal to the metal.

As a result, increase in contact resistance can be restricted, a reliability of the electric contact can be improved, and a life of the electric contact can be increased. When the electric contact is used for an electronic device, a malfunction due to increase in resistance of the electric contact can be restricted.

In the composite material, the reducing. agent 25 is dispersed in the metal matrix of the metal. Thus, the composite material has a conductivity and the electric contact can be made of the composite material.

In another example, an electrode made of copper or copper alloy may be covered with the composite material. In another example, an electrode made of copper or copper alloy may be plated with nickel, and then an outermost surface of the electrode may be covered with the composite material.

In another example, two electrodes may be contact with one another through an intermediate layer that is made of a conductive filler made of the composite material or an adhesive agent in which a conductive filler made of the composite material is dispersed.

In any case where the composite material is used for the electric contact electrode, the electric contact film, or the conductive filler, the metal wears and is oxidized due to micro sliding, and the reducing agent exposed by wear reduces the oxidized metal. The composite material may also be used for more than one of the electric contact electrode, the electric contact film, and the conductive filler.

The metal and the reducing agent included in the composite material are not limited as long as the reducing agent is capable of reducing the oxide of the metal at room temperature. The reducing agent may be selected from reducing agents that are capable of reducing a metal oxide without dissolving the metal oxide at room temperature. For example, the metal may be copper, copper alloy whose primary component is copper, tin, or tin alloy whose primary component is tin in view of cost and conductivity.

When the metal is copper or copper alloy whose primary component is tin, the reducing agent is capable of reducing copper oxide. For example, the reducing agent may include at least one of L-ascorbic acid, D-araboascorbic acid, the acetaldehyde 2,4-dinitro phenyl hydrazone, 4-hydrazino benzoic acid, diethylhydroxylamine, 1,3-dihydroxyacetone dimer, dehydroascorbic acid, 2,3-diketogulonic acid, L-xylosone, 2-ketoglutaric aldehyde, and reductic acid.

When the metal include tin or tin alloy whose primary component is tin, the reducing agent is capable of reducing tin oxide. For example, the reducing agent may include at least one of dibenzylhydroxylamine and 1,3-dihydroxyacetone dimer.

The composite material in which the reducing agent is dispersed in the metal matrix can be manufactured, for example, as described below. In a plating bath that includes a metal salt of the metal as primary component, the reducing agent that is capable of reducing the oxide of the metal at room temperature is added. The reducing agent is dissolved uniformly or becomes a colloidal solution state if the reducing agent is not dissolved. A complexing agent is added to the plating bath as needed, and a plated member is treated with electroplating. Accordingly, eutectoid of the metal matrix and the reducing agent is formed on the plated member.

By the above-described method, the reducing agent can be uniformly dispersed in the metal matrix as polycrystalline substance of micro-particles, Thus, when the composite material wears due to repeated micro sliding, the reducing agent can always perform reducing function, and increase in contact resistance can be restricted.

Whether the reducing agent is uniformly dispersed in the metal matrix as polycrystalline substance of micro-particles can be observed by a TEM image or a mapping analysis.

The reducing agent includes carbon. When a concentration of the reducing agent in the composite material is defined such that a concentration of the carbon is equal to or greater than 1 mass % of a total mass of the composite material, the reducing agent can be uniformly dispersed in the metal matrix as the polycrystalline substance of micro-particies of 20 nm to 50 nm, and an oxidation restriction effect of the composite material can be improved dramatically.

Figure 3A:
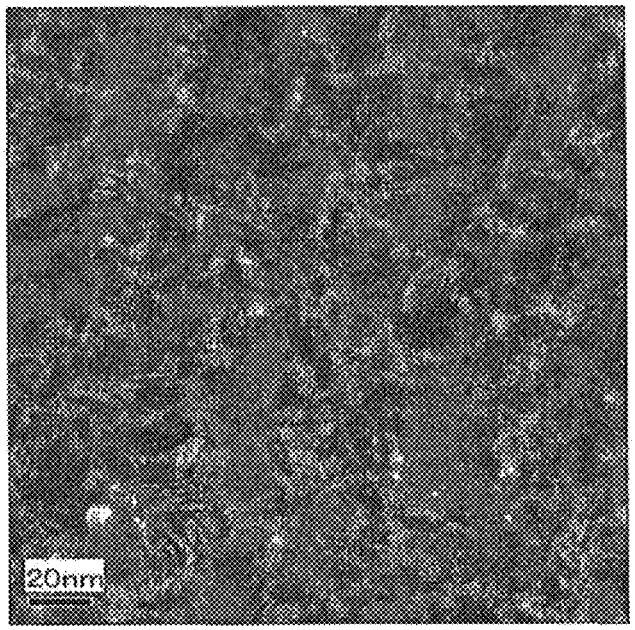
FIG. 3A is a diagram showing a TEM image in which a reduction agent is dispersed in a matrix and FIG. 3B is an illustrative view of the diagram shown in FIG, 3A.
Figure 3B:
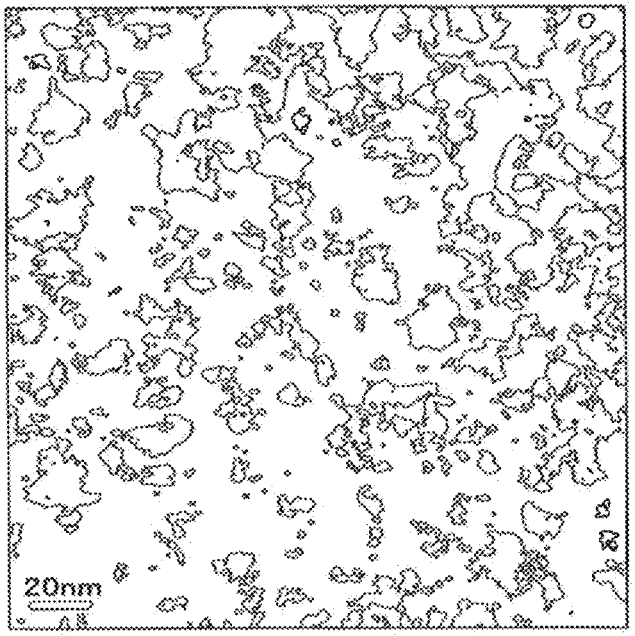
Figure 4A:
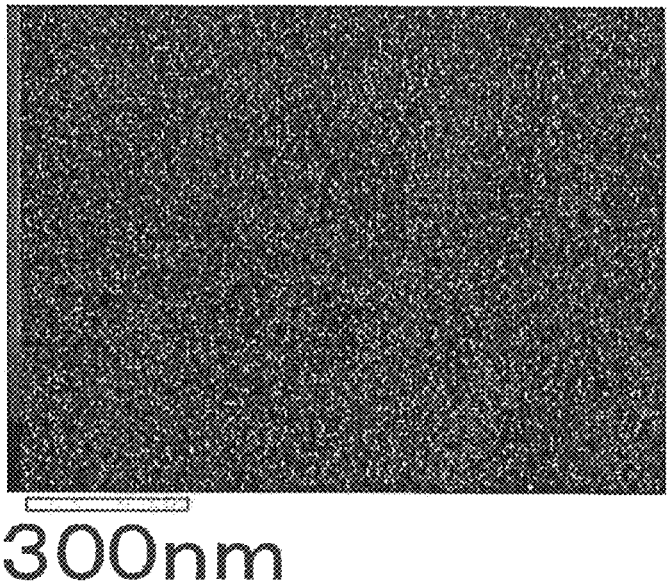
FIG. 4A is a diagram showing a result of mapping analysis in which a reduction agent is dispersed in a matrix and FIG. 4B is an illustrative view of the diagram shown in FIG. 4A.
Figure 4B:
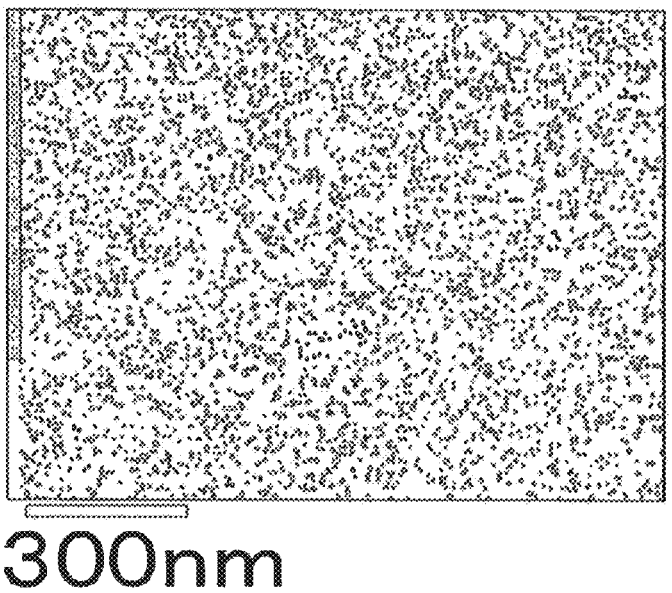

As shown in FIG. 3A and FIG. 3B, the reducing agent is uniformly dispersed in the metal matrix as polycrystalline substance of micro-particles. As shown in FIG. 4A and FIG. 4B, a dispersion size of C is equal to or less than 20 nm.

An electric contact electrode made of the composite material can be formed by forming eutectoid of the metal and the reducing agent on a plated member using the above-described method and processing the eutectoid. The plated member is not limited. For example, the plated member may be made of stainless in view of detachment property.

An electric contact film made of the composite material can be formed by plating a surface of a plated member using the above-described method. In the present case, the plated member may be an electric contact electrode made of copper, brass, or phosphor bronze or an electric contact electrode made of copper, brass, or phosphor bronze and covered with, for example, nickel.

A conductive filler made of the composite material can be formed by forming eutectoid of the metal and the reducing agent on a plated member using the above-described method and detaching the eutectoid composite material from the plated member. The plated member is not limited. For example, the plated member may be made of stainless so that the composite material can be easily detached.

In a case where a copper plating bath added with L-ascorbic acid as the reducing agent is used and a reducing-agent composite film is formed by a composite plating method, if at least one of 1,10-phenanthroline and 2,2'-bipyridyl is added as a complexing agent to the plating bath, stable three-component system metal complex cations of [Cu/L-ascorbic acid/Ligand]+ are formed in the plating path.

When an electroplating is performed with the three-component system metal complex cations, eutectoid of copper and more reducing agent can be formed compared with a case where the complexing agent is not added. For example, eutectoid of copper and the reducing agent of equal to or greater than 1 mass % can be formed. Accordingly, when the composite material is used for the electric contact, the oxidation restriction function at sliding can be improved drastically.

In a plating path in which a reducing agent having reduction function at room temperature directly dissolves, because the reducing agent decomposes with time, it is difficult to stabilize the amount of the eutectoid of the reducing agent. However, when L-ascorbic acid is used as a reducing agent component, an appropriate amount of reduction active component can be stably deposited.

The reason is in a feature of decomposition products of L-ascorbic acid. L-ascorbic acid is decomposed in order of dehydroascorbic acid, 2, 3-diketogulonic acid, L-xylosone, 2-ketoglutaric aldehyde, and reductic acid. All of the decomposition products has a strong reducing capability and are called reductone.

L-ascorbic acid, which is starting material, and reductic acid, which is a decomposition product, have keto-enediol structure and show strong reduction activity. Thus, decomposition of the reducing agent in the plating bath can be allowed, and the plating bath can be applied to mass production.

Thus, when L-ascorbic acid is used as the reducing agent component and the metal complex cations are formed as described above, a large amount of eutectoid of the reducing agent can be stably secured.

D-araboascorbic acid, acetaldehyde 2, 4-dinitro phenyl hydrazone and 4-hydrazinobenzoic acid, diethyl hydroxylamine, 1,3-dihydroxyacetone dimer can be used in a manner similar to L-ascorbic acid.

In cases where amine such as diethylhydroxylamine is used as the reducing agent, the reducing agent becomes cations in the plating bath. Thus, the eutectoid of the metal matrix and the reducing agent can be formed on the plated member without the complexing agent.

Examples of the present disclosure will be described below. In the examples, copper is used as a matrix metal and L-ascorbic acid is used as a reducing agent. A. plating bath includes copper sulfate ($CuSO_4$), sulfuric acid ($H_2SO_4$), the reducing agent, and a complexing agent at concentrations shown in FIG. 6. Electrodes made of phosphor bronze (C5210H) and having a thickness of 0.64 mm are used as cathode and are plated with current density shown in FIG. 6. Accordingly, electric contact electrodes covered with reducing agent dispersion copper plating films having a thickness of 10 μm are formed.

Figure 5:
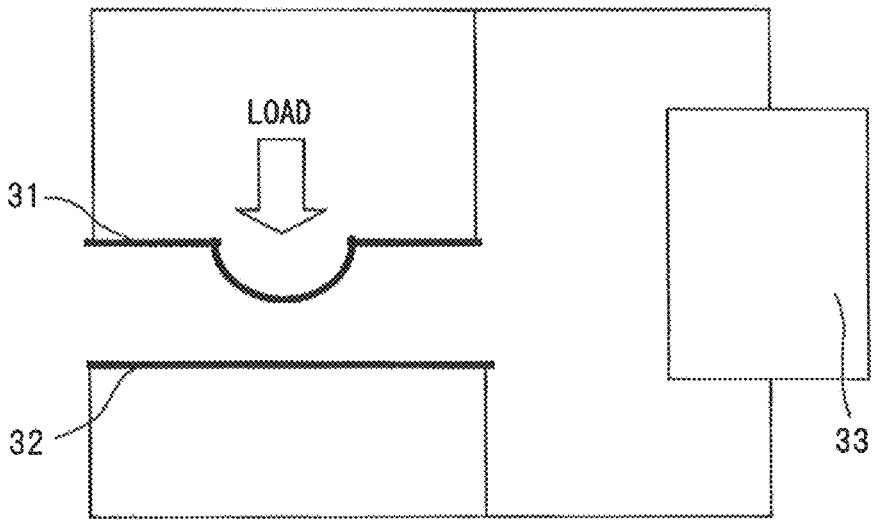
FIG. 5 is a diagram showing a sliding test.

The electric contact electrodes are treated with a sliding test. In the sliding test, as shown in FIG. 5, an embossing specimen 31 is applied with a load so as to come in contact with a plate specimen 32 and a contact resistance is measured with a resistance meter 33 having four terminals. The load is set to 3 N, an amplitude is set to 50 μm, and a frequency is set to 1 Hz.

Manufacturing conditions of the specimens and results of the sliding test are shown in FIG. 6.

As described above, when the composite film is used, increase in contact resistance due to sliding can be restricted compared with an electric contact electrode treated with a conventional plating. Especially, when the reducing agent includes carbon, and a concentration of the reducing agent is defined such that a concentration of the carbon is equal to or greater than 1 mass % of a total mass of the composite material, an electric contact electrode that can effectively restrict increase in contact resistance due to sliding can be formed.

What is claimed is:

1. An electric contact electrode, comprising:

a composite material surface layer portion configured to electrically contact another electrically conductive surface, wherein the composite material is a metal matrix containing metal as a matrix material, a reducing agent containing carbon is dispersed in the metal matrix, and the reducing agent is present in an amount effective for reducing an oxide of the metal at room temperature.

2. An electric contact structure comprising:

a first electrode; and a second electrode being in contact with the first electrode, wherein one of the first electrode and the second electrode is the electric contact electrode according to claim 1.

3. The electric contact electrode according to claim 1, wherein the reducing agent containing carbon is present in the matrix material in an amount based on the carbon being equal to or greater than 1 mass % of a total mass of the composite material.

4. The electric contact electrode according to claim 1, wherein the reducing agent includes at least one of L-ascorbic acid, D-araboascorbic acid, acetaldehyde 2,4-dinitro phenyl hydrazone, 4-hydrazino benzoic acid, diethylhydroxylamine, 1,3-dihydroxyacetone dimer, dehydroascorbic acid, 2,3-diketogulonic acid, L-xylosone, 2-ketogiutaric aldehyde, and reductic acid, and wherein the metal includes copper or copper alloy whose primary component is copper.

5. An electric contact film comprising:

a composite material surface layer portion configured to electrically contact another electrically conductive surface, wherein the composite material is a metal matrix containing metal as a matrix material, a reducing agent containing carbon is dispersed in the metal matrix, and the reducing agent is present in an amount effective for reducing an oxide of the metal at room temperature.

6. An electric contact structure comprising:

a first electrode;

a second electrode being in contact with the first electrode; and the electric contact film according to claim 5 covering a surface of one of the first electrode and the second electrode.

7. The electric contact film according to claim 5, wherein the reducing agent containing carbon is present in the matrix material in an amount based on the carbon being equal to or greater than 1 mass % of a total mass of the composite material.

8. The electric contact film according to claim 5, wherein the reducing agent includes at least one of L-ascorbic acid, D-araboascorbic acid, acetaldehyde 2,4-dinitro phenyl hydrazone, 4-hydrazino benzoic acid, diethylhydroxylamine, 1,3-dihydroxyacetone dimer, dehydroascorbic acid, 2,3-diketogulonic acid, L-xylosone, 2-ketoglutaric aldehyde, and reductic acid, and wherein the metal includes copper or copper alloy whose primary component is copper.

9. A conductive filler, comprising:

a composite material surface layer portion configured to electrically contact another electrically conductive surface, wherein the composite material is a metal matrix containing metal as a matrix material, a reducing agent containing carbon is dispersed in the metal matrix, and the reducing agent is present in an amount effective for reducing an oxide of the metal at room temperature.

10. An electric contact structure comprising:

a first electrode;

an intermediate film made of the conductive filler according to claim 9 or an adhesive agent in which the conductive filler according to claim 9 is dispersed; and a second electrode being in contact with the first electrode through the intermediate film.

11. The conductive filler according to claim 9, wherein the reducing agent containing carbon is present in the matrix material in an amount based on the carbon being equal to or greater than 1 mass % of a total mass of the composite material.

12. The conductive filler according to claim 9, wherein the reducing agent includes at least one of L-ascorbic acid, D-araboascorhic acid, acetaldehyde 2,4-dinitro phenyl hydrazone, 4-hydrazine benzoic acid, diethylhydroxylamine, 1,3-dihydroxyacetone dimer, dehydroascorbic acid, 2,3-diketugulonic acid, L-xylosone, 2-ketoglutaric aldehyde, and reductic acid, and wherein the metal includes copper or copper alloy whose primary component is copper.

* * * * *